US005644330A

United States Patent [19]

Catchpole et al.

[11] Patent Number: 5,644,330

[45] Date of Patent: Jul. 1, 1997

[54] DRIVING METHOD FOR POLYMER STABILIZED AND POLYMER FREE LIQUID CRYSTAL DISPLAYS

[75] Inventors: Clive Catchpole, Beverly Hills, Mich.; Haiji Yuan, Stow; Minhua Lu, Kent, both of Ohio

[73] Assignee: Kent Displays, Inc., Kent, Ohio

[21] Appl. No.: 517,991

[22] Filed: Aug. 22, 1995

Related U.S. Application Data

[63] Continuation of Ser. No. 288,831, Aug. 11, 1994, abandoned.

[51] Int. Cl.[6] ..... G09G 3/36

[52] U.S. Cl. ..... 345/95; 345/210; 345/214; 349/113

[58] Field of Search ..... 345/94–96, 210, 345/211, 214; 359/55, 51, 70, 105

[56] References Cited

U.S. PATENT DOCUMENTS

| | | | |
|---|---|---|---|
| 3,976,362 | 8/1976 | Kawakami | 345/95 |
| 4,731,610 | 3/1988 | Baron et al. | 345/96 |
| 5,251,048 | 10/1993 | Doane et al. | 359/70 |
| 5,252,954 | 10/1993 | Nagata et al. | 345/210 |

OTHER PUBLICATIONS

Doane, et al., Front-lit Flat Panel Display from Polymer Stabilized Cholesteric Textures, Japan Display '92, pp. 73–76.

*Primary Examiner*—Richard Hjerpe
*Assistant Examiner*—Amare Mengistu
*Attorney, Agent, or Firm*—Harness, Dickey & Pierce, P.L.C.

[57] ABSTRACT

A display device (10) having first and second substrates (12) and (30) and a layer of a PSCT or PFCT liquid crystal material disposed therebetween. The display is driven by an addressing scheme in which voltages are applied either in phase or out of phase in order to switch the liquid crystal material between stable states.

19 Claims, 3 Drawing Sheets

DRIVING METHOD FOR POLYMER STABILIZED AND POLYMER FREE LIQUID CRYSTAL DISPLAYS

This is a continuation of U.S. patent application Ser. No. 08/288,831 now abandoned, filed Aug. 11, 1994 titled DRIVING METHOD FOR POLYMER STABILIZED AND POLYMER FREE LIQUID CRYSTAL DISPLAYS.

TECHNICAL FIELD

This invention relates in general to liquid crystal displays, and in particular to methods for electronically addressing poller stabilized and polymer free cholesteric texture liquid crystal displays ("LED").

BACKGROUND

Recent concerted efforts in the field of liquid crystal materials have yielded a new class of reflective, cholesteric texture materials and devices. These liquid crystal materials have a periodic modulated optical structure that reflects light. The liquid crystal material comprises a nematic liquid crystal having positive dielectric anisotropy and chiral dopants. These materials, known as polymer stabilized cholesteric texture (PSCT) and polymer free cholesteric texture (PFCT) are fully described in, for example, U.S. Pat. No. 5,251,048 and patent application Ser. Nos. 07/694,840 and 07/969,093, the disclosures of which are incorporated herein by reference.

Reflective cholesteric texture liquid crystal displays (both PSCT and PFCT) have two stable states at a zero applied field. One such state is the planar texture state which reflects light at a preselected wavelength determined by the pitch of the cholesteric liquid crystal material itself. The other state is the focal conic texture state which is substantially optically transparent. By stable, it is meant that once set to one state or the other, the material will remain in that state, without the further application of an electric field. Conversely, other types of conventional displays, each liquid crystal picture element must be addressed many times each second in order to maintain the information stored thereon. Accordingly, PSCT and PFCT materials are highly desirable for low energy consumption applications, since once set they remain so set.

The configuration of LCDs using PSCT and PFCT materials is substantially the same as in conventional passive LCDs: picture elements (pixels) are addressed by crossing lines of transparent conducting lines known as rows and columns. Conventional methods for addressing or driving such displays can be understood from a perusal of FIGS. 1 and 2. FIG. 1 illustrates a table showing the state of the liquid crystal material after the application of various driving voltages thereto. The liquid crystal material begins in a first state, either the reflecting state or the non-reflecting state, and is driven with an AC voltage, having an rms amplitude above $V_4$ in FIG. 1. When the voltage is removed quickly, the liquid crystal material switches to the reflecting state and will remain reflecting. If driven with an AC voltage between $V_2$ and $V_3$ the material will switch into the non-reflecting state and remains so until the application of a second driving voltage. If no voltage is applied, or the voltage is well below $V_1$, then the material will not change state, regardless of the initial state. It is important to note however, that the application of voltages below $V_1$ will create optical artifacts (as discussed in greater detail hereinbelow), but will not cause a switch in the state of the material.

The conventional method of driving PSCT and PFCT displays is described in an article entitled "Front-Lit Flat Panel Display from polymer Stabilized Cholesteric Textures", by Doane, et al. and published in Conference Record, page 73, Japan Display '92, Society of Information Displays, October 1992 (the "Doane Article"). The Doane Article teaches addressing a row in a display by applying an AC waveform with an rms amplitude $V_{rs}$ between $V_2$ and $V_3$. A column voltage of zero is applied to the columns of all the pixels in the rows which are to be in the non-reflecting state. An AC voltage with rms amplitude greater than or equal to $V_4-V_{rs}$, but less than $V_1$ is applied to the columns of all pixels which are to be in the reflecting state.

The column voltages are out of phase with respect to the row voltages so that the effective voltage across the selected pixels is greater than or equal to $V_4$. The amplitude of the column voltage is always less than $V_1$, thus as the addressing of the display progresses from row-to-row, the column voltage does not alter the state of the pixels in rows which have already been addressed. This may be appreciated from a review of FIG. 2. Specifically, for a given single pixel, at time $t_1$ no voltage is applied to the row address line of the display for the pixel, and a column voltage of $V_c$ (either + or −). The result is no change in the pixel since the pixel's row was not selected. During time $t_2$ no voltage is applied to either the row or column lines for the pixel, and again the pixel is unchanged.

During time $t_3$ however, a voltage of $V_{rs}$ (either + or −) is applied to the pixel row address line, and a voltage of $V_c$ (either + or −) is applied to the column address line. As a result, the pixel is driven to the reflecting state as shown in FIG. 1. During time $t_4$, a voltage of $V_{rs}$ (either + or −) is applied to the pixel row address line, and no voltage is applied to the column address line. As a result, the pixels is driven to the non-reflecting state.

While this method of driving PSCT and PFCT displays has been the accepted standard, it nonetheless possesses several characteristics which have rendered it increasing untenable for commercial applications. For example, while the image on the display is being updated, the display shows annoying optical artifacts from the previously displayed information. The electro-optical curve of the reflecting state measured with voltage on is different than with voltage off. Moreover neither curve is ideally fiat between zero volts and $V_1$. Thus, as columns are being addressed, the reflectance of the material will vary slightly, resulting in an undesirable flickering of the display. This flicker increases as the voltage applied along the columns is increased, thus driving pixels, even in unselected rows, closer to $V_1$.

Moreover, in this type of LCD, the following mathematical relationship must be maintained in order to achieve consistent uniform addressing:

$$V_1 > V_4 - V_3$$

As described herein, $V_4$ is typically about 40 volts, $V_3$ is typically about 34 volts, and $V_1$ is typically about 10 volts. However, cell spacing, actual material composition, and temperature all substantially impact actual voltage requirements. Thus, a large scale, commercially producible display is not readily producible. This is because there is not a sufficient voltage margin as required for production tolerances. Further, for displays that operate in particular areas of the spectrum, (for example yellow) the prior art driving scheme will no work since they exhibit large hysteresis, hence larger ($V_4-V_3$) or a lower $V_1$.

Moreover, the driving scheme of the prior art has not been adapted to completely eliminate residual memory effects from images that have been retained on the display for some time. Specifically, prior art attempts to deal with residual image memory effect required combining several cycles of AC voltage to write a new row of information, writing the information to the entire display concurrently, and increasing the cycle time of the AC voltages applied. These attempts however, did not resolve the problems of residual memory effects. Moreover, they are distracting to the viewer, as the cycle time for this process is approximately 100 milliseconds.

Thus, there exists a need for an improved scheme for driving or electronically addressing a PSCT or PFCT LCD. Such a scheme should be easily integrated into such devices, and provide for effective addressing of large, color displays.

DETAILED DESCRIPTION OF THE PREFERRED EMBODIMENT

Figure 1:
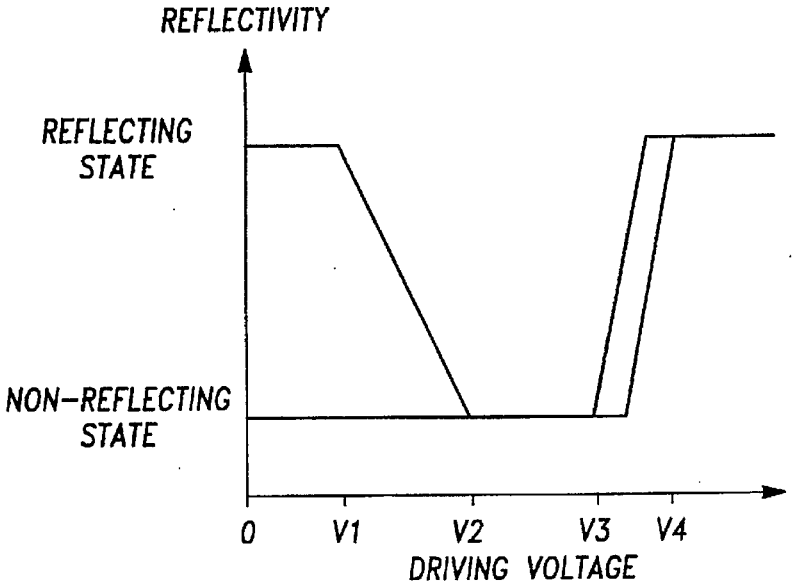
FIG. 1 is a graph illustrating electro-optical responses for PSCT and PFCT LCDs.
Figure 2:
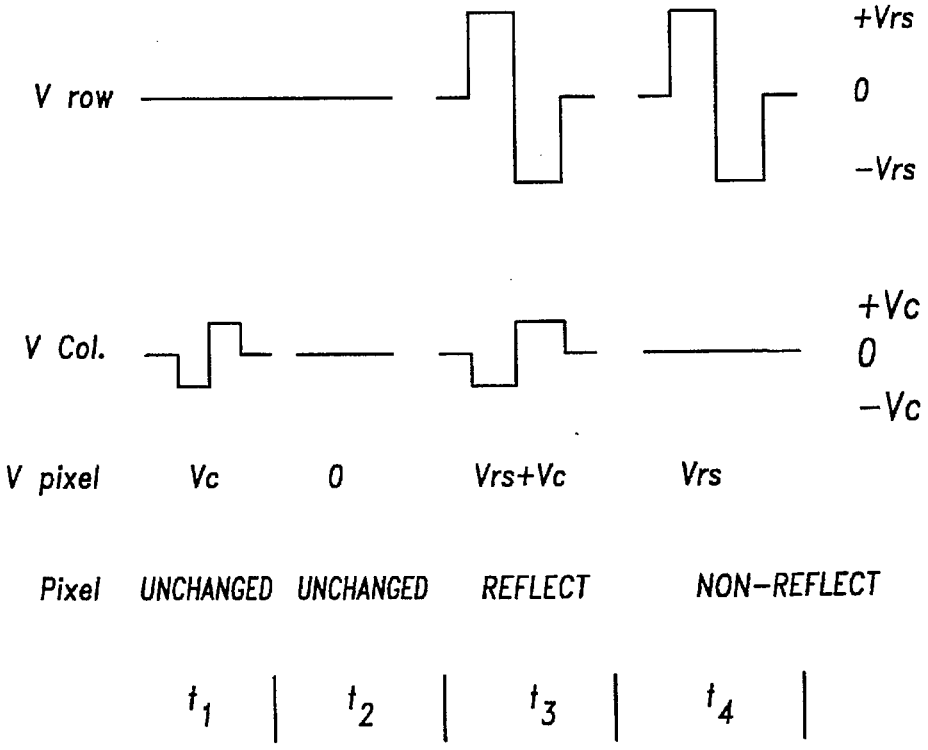
Fig-2 PRIOR ART
FIG. 2 is a table illustrating the method for electronically addressing a pixel by the application of voltages to the rows and columns of an LCD, according to the prior art.

While the specification concludes with claims defining the features of the invention that are regarded as novel, it is believed that the invention will be better understood from a consideration of the following description in conjunction with the drawing figures, in which like reference numerals are carried forward.

Figure 3:
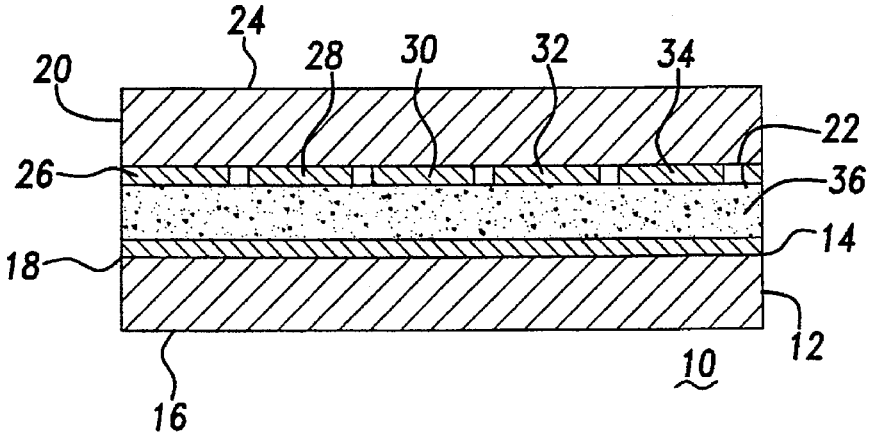
FIG. 3 is a partial cross-sectional side view of a cholesteric texture liquid crystal/display in accordance with the instant invention.

Referring now to FIG. 3, there is illustrated therein a partial cross-sectional side view of a PSCT or PFCT display device in accordance with the instant invention. The display 10 includes a first display substrate 12 fabricated of an insulating material such as glass, plastic or some other polymeric material, examples of which include Donnelly Applied Films' ITO (indium tin oxide) coated sodalime glass substrates, Corning's silicate glass substrates, Southwall Technologies' ITO coated plastic substrates, and combinations thereof. The substrate 12 has first and second major surfaces 14 and 16. On the first major surface 14 of substrate 12 is disposed a layer of an electrically conductive material 18. The electrically conductive layer 18 should be a transparent material. Accordingly, the electrode layer 18 may be a thin layer of metal such a silver, copper, titanium, molybdenum, and combinations thereof, so long as the metals are very thin, and non-reflective. Alternatively, the layer 18 maybe a thin layer of a transparent conductive material such as indium tin oxide. The layer may be fabricated as a plurality of elongated strips on the surface of the substrate 12.

Disposed opposite the first substrate 12 is a second substrate 20 fabricated of a high quality, transparent material such a glass or plastic. The substrate 20 has first and second major surfaces 22, and 24 respectively. Disposed on the first major surface 22 is a plurality of elongated strip electrodes 26, 28, 30, 32, 34, fabricated of a transparent conductive material, such as those described hereinabove with respect to layer 18.

The substrates 12 and 20 are arranged in opposed, facing relationship so that said layers of conductive material are parallel and facing one another. Disposed between said layers of conductive material is a layer of PSCT or PFCT liquid crystal material 36. The liquid crystal material has a periodic modulated optical structure that reflects light. The liquid crystal material comprises a nematic liquid crystal having positive dielectric anisotropy and chiral dopants. The material may further include a polymer gel or dye material. Thus, an electrical field may be applied to a layer of PSCT or PFCT liquid crystal material disposed therebetween. Once such a field is removed, the material is set to one of two said stable states, where it will remain until a new field is applied.

Figure 4:
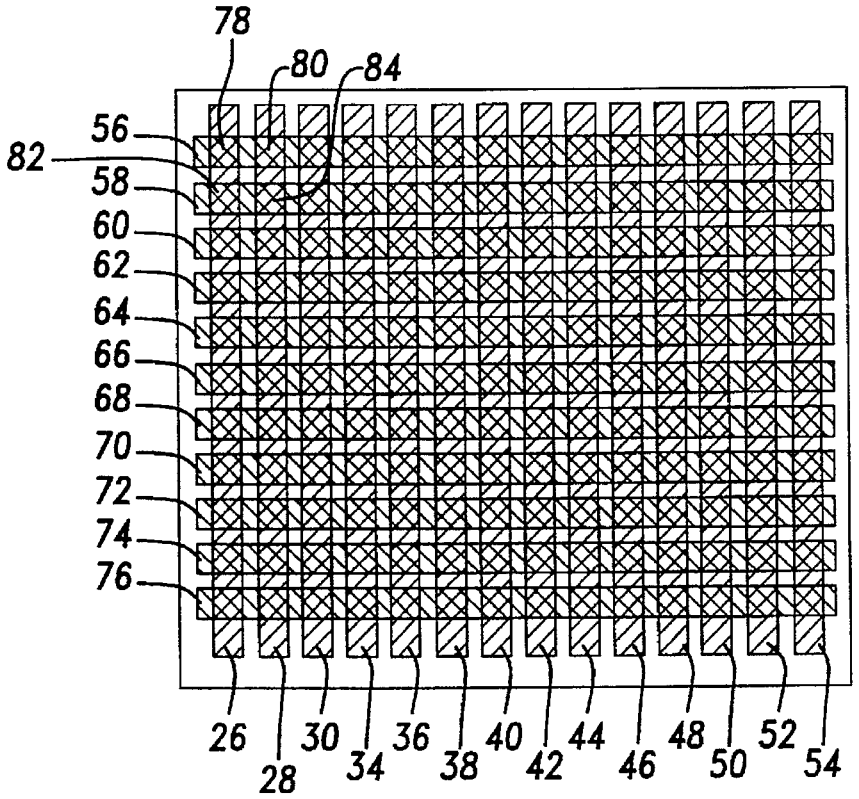
FIG. 4 is a top plan view of a cholesteric texture liquid crystal display in accordance with the instant invention.

Referring now to FIG. 4, there is illustrated therein a front elevational view of the device illustrated in FIG. 3. The LCD column address lines 26, 28, 30, 32, 34, 36, 38, 40, 42, 44, 46, 48, 50, 52, 54, and a plurality of orthagonally disposed row address lines 56, 58, 60, 62, 64, 66, 68, 70, 72, 74, and 76. At the intersection of each row and column, there is a cross-over point, such as 78, 80, 82, 84 defining the region of a picture element or pixel. It is to be understood that while only four cross-over points have been identified, one exists at each intersection. Moreover, it is to be understood that while the LCD illustrated in FIG. 4 is a matrix of 11 rows by 14 columns, the LCD may be any number of rows and columns, arranged in any shape.

As noted above, the row and column address lines are fabricated of electrically conductive materials. Further, they electrically coupled to electronic driving circuitry (not shown) for applying electronic driving or addressing voltages to the LCD. The circuitry is typically disposed around the peripheral edges of the display so as to not reduce the area of display available.

Figure 5:
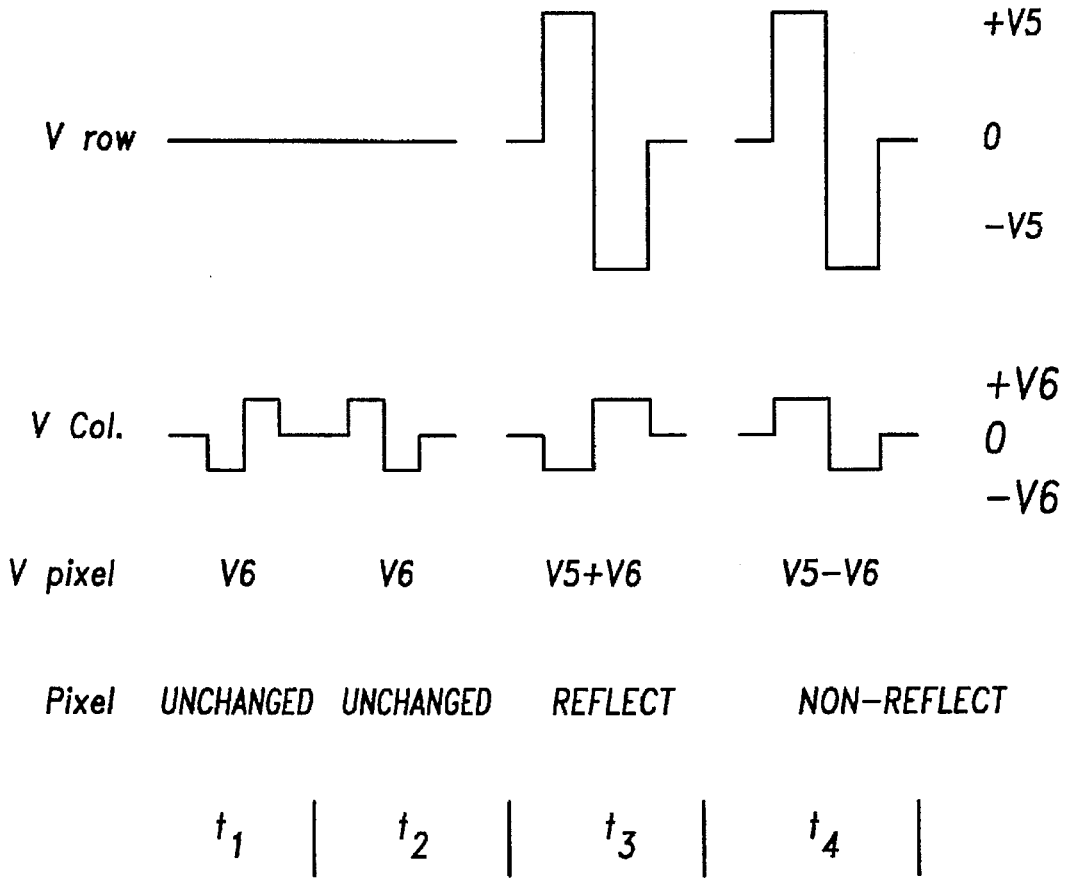
FIG. 5 is a table illustrating a method for electronically addressing a pixel by the application of voltages to the rows and columns of an LCD, in accordance with the instant invention.

Referring now to FIG. 5, there is illustrated therein a method for electronically addressing a pixel by the application of voltages to the rows and columns of an LCD, in accordance with the instant invention. The voltages are applied to the pixels of the display via the circuitry and address lines described above. The method of driving the display comprises the steps of applying a row voltage to a row of pixels to be addressed. The row voltage is set to an AC rms value $V_5$ which is between $V_3$ and $V_4$, and preferably equal to $(V_3+V_4)/2$. The column voltage has an rms value greater than or equal to $(V_4-V_5)$, and smaller than $V_1$, and will be referred to as $V_6$. This column voltage will be out of phase with the row voltage if the pixel is to be addressed to the reflecting state. The column voltage is in phase with the row voltage if the pixel is to be addressed to the non-reflecting state.

More particularly, if the pixel is to be driven to the reflecting state, a voltage of $V_5$ is applied to the row in which the selected pixel resides. Simultaneously, a voltage $V_6$, is applied, out of phase with the row voltage, to the column of the selected pixel. The result after the application of the row and column voltage is a pixel driven to a voltage above $V_4$ and hence reflective. Similarly, if the column voltage $V_6$ is in phase, the voltage at the pixel is less than $V_3$ (but greater than $V_2$) and the pixel will be non-reflecting. As an additional advantage of the instant invention, the amplitude of $V_6$ may be kept uniformly low so that it's effect on non-selected rows is minimal, and does not drive non-selected close to $V_1$, hence reducing optical artifacts as described above. Typical values for the voltages described above are as follows: $V_1 \approx 10$ V; $V_3 \approx 35$ V; $V_4 \approx 40$ V; $V_5 \approx 38$ V; and $V_6 \approx 5$ V.

The pixel to be addressed now receives appropriate driving voltage levels, however, the column voltage required is reduced by ½ of the prior art ($V_6 > (V_4 - V_3)/2$). Accordingly, the materials may be addressed if $V_1 > (V_4 - V_3)/2$, effectively doubling the range of usable column voltage. This improvement allows for expanded voltage margins, making commercial production tolerances available. Moreover, the proposed driving scheme allows for use of materials reflecting in all part of the visible spectrum.

The driving scheme of the instant invention may be better understood from a perusal of FIG. 5. For example, during times $t_1$ and $t_2$ a pixel is addressed by a 0 voltage applied to the row address line. As the row is not selected, the pixel will not be driven, regardless of the voltage applied along the column address line. Hence, even though the column address line is applying a voltage of $V_6$ during times $t_1$ and $t_2$, the pixel remains unchanged.

Thereafter in time $t_3$, the chosen pixel's row is selected by the application of a voltage equal to $V_5$ thereto. Concurrently, the column address line is applying an out-of-phase voltage of $V_6$ to the pixel, resulting in a total voltage of $V_5+V_6$ across the pixel, driving it into the reflecting state. Thereafter, during time $t_4$ similar voltage levels are applied to the pixel via the row and column address lines: however, the voltages are applied in phase resulting in a voltage equal to $V_5-V_6$. As a result, the display is driven into the non-reflecting state.

Further, residual effects from old images stored on the display may be eliminated by applying the instant driving method. Memory effects may be eliminated by the application of an AC voltage with a suitable amplitude, and then write the entire new information to the display. A suitable voltage for this cleaning effect is typically between $V_2$ and $V_3$, or greater than $V_4$, or a combination of both. This voltage may be applied by causing all the rows to be driven with voltage $V_5$, and all the rows to be driven at voltage $V_6$, either in phase or out of phase.

If the clearing voltage is between $V_2$ and $V_3$, then after the clearing step the display will be in the non-reflecting state, and the desired image may be written. If the clearing voltage is greater than $V_4$, then the display will be in the reflecting state as the desired image is being written. It is preferred to applying a clearing voltage of greater than $V_4$ since this voltage will clear both the bulk and the boundary parts of the LCD. Alternatively, if the clearing voltage of greater than $V_4$ is immediately followed by a clearing voltage of between $V_2$ and $V_3$, the LCD will appear to be in the non-reflecting state after clearing, presenting a more aesthetically pleasing appearance to the viewer.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method of operating a liquid crystal display device having a first substrate having a plurality of substantially parallel address lines disposed thereon, and a second substrate having a plurality of substantially parallel address lines disposed thereon, said first and second substrates operatively disposed in facing, parallel relationship so that said address lines on said first substrate are disposed at an angle with respect to the address lines of said second substrate to form a plurality of crossover points therewith, each crossover point defining a picture element, said method comprising the steps of:

providing a layer of a liquid crystal material having a periodic modulated optical structure that reflects light, disposed between said first and second substrates, said material being switchable between a transparent state in which said material is substantially transparent, and a reflecting state which reflects light, wherein said liquid crystal material is in the reflecting state when driven by a first AC voltage level and is in the transparent state when driven by a second AC voltage level;

applying a first AC voltage to at least one address line on said first substrate, said first AC voltage being between the first AC voltage level and the second AC voltage level; and applying a second AC voltage to at least one address line on said second substrate, said second AC voltage being sufficient in amplitude when applied out of phase with said first AC voltage to switch said liquid crystal material into said reflecting state, and when applied in phase with said first AC voltage to switch said liquid crystal material to said transparent state, said second AC voltage being less than a threshold voltage, said threshold voltage being an AC voltage where any voltage potential, including a zero voltage potential, applied to the liquid crystal material below the threshold voltage will not change the liquid crystal material from either the transparent state or the reflecting state.

2. A method as in claim 1, wherein said liquid crystal material is a cholesteric texture liquid crystal material.

3. A method as in claim 2, wherein said liquid crystal material is polymer stabilized cholesteric texture liquid crystal material.

4. A method as in claim 2, wherein said liquid crystal material is polymer free cholesteric texture liquid crystal material.

5. A method as in claim 2, wherein said liquid crystal material is a polymer stabilized cholesteric texture liquid crystal material.

6. A method as in claim 2, wherein said liquid crystal material is a polymer free cholesteric texture liquid crystal material.

7. A method as in claim 1, wherein said first AC voltage is a higher voltage than said second AC voltage level.

8. A method as is claim 1, including the further step of clearing at least part of an image stored on said liquid crystal display.

9. A method as in claim 8, wherein at least part of said display is cleared to said transparent state, said method including the further steps of: applying said first AC voltage level to at least one picture element; applying said second AC voltage level to said at least one picture element; and applying a clearing voltage to said picture element.

10. A method as in claim 8, wherein at least part of said display is cleared to the transparent state, said method including the further steps of: applying said first AC voltage level to at least one picture element; and applying a clearing voltage to said picture element.

11. A method as in claim 8, wherein at least part of said display is cleared to the transparent state, said method including the further steps of: applying said second AC voltage level to at least one picture element; and applying a clearing voltage to said picture element.

12. The method of claim 1 wherein the liquid crystal material has a first AC threshold voltage, $V_1$, for beginning transition from said reflecting state to said transparent state; a first AC saturation voltage, $V_2$, for driving of said display from said reflecting state to said transparent state; a second AC threshold voltage, $V_3$, for beginning transition from said transparent state to said reflecting state and a second AC saturation voltage, $V_4$, for driving said display to said reflecting state and wherein $V_1<V_2<V_3<V_4$.

13. The method of claim 12 wherein said first AC voltage level is greater than or equal to $V_4$.

14. The method of claim 12 wherein said second AC voltage level is not more than V but greater than $V_2$.

15. The method of claim 12, wherein said first AC voltage is greater than $V_2$.

16. The method of claim 12 wherein said second AC voltage is less than $V_1$.

17. A method of operating a cholesteric liquid crystal display device having a first substrate having a plurality of substantially parallel address lines disposed thereon, and a second substrate having a plurality of substantially parallel address lines disposed thereon, said first and second substrates operatively disposed in facing, parallel relationship so that said address lines on said first substrate are disposed at an angle with respect to the address lines of said second substrate to form a plurality of crossover points therewith, each crossover point defining a picture element, said method comprising the steps of:

providing a layer of a cholesteric liquid crystal material having periodic modulated optical structure that reflects light, disposed between said first and second substrates, said material being switchable between a transparent state in which said material is substantially transparent, and a reflecting state which reflects light, wherein said liquid crystal material reflects light due to the application of a first AC voltage level, and is transparent due the application of a second AC voltage level; said material having a first AC threshold voltage, $V_1$, for beginning transition from said reflecting state to said transparent state; a first saturation voltage, $V_2$, for driving of said display from said reflecting state to said transparent state; a second AC threshold voltage, $V_3$, for beginning transition from said transparent state to said reflecting state and a second AC saturation voltage, $V_4$, for driving said display to said reflecting state and wherein $V_1<V_2<V_3<V_4$;

applying a first AC voltage to at least one address line on said first substrate; said first AC voltage being between said second AC voltage level and said first AC voltage level; and applying a second AC voltage to at least one address line on said second substrate, said second AC voltage being sufficient in amplitude when applied out of phase with said first AC voltage to switch said liquid crystal material into said reflecting state, and when applied in phase with said first AC voltage to switch said liquid crystal material to said transparent state, said second AC voltage being less than the second AC threshold voltage so as to prevent the liquid crystal material from changing from either the transparent state or the reflecting state and said second AC voltage being greater than $V_4-V_3/2$ and wherein $V_1>V_4-V_3/2$ whereby the effective range of useable address line voltage is expanded.

18. The method of claim 17 further comprising clearing at least part of the display by applying said first AC voltage level or said second AC voltage level to all of the address lines to be cleared.

19. A method as in claim 17 wherein said liquid crystal material is a cholesteric texture liquid crystal material.

* * * * *

UNITED STATES PATENT AND TRADEMARK OFFICE

CERTIFICATE OF CORRECTION

PATENT NO. : 5,644,330

DATED : July 1, 1997

INVENTOR(S) : Clive Catchpole, et al.

It is certified that error appears in the above-indentified patent and that said Letters Patent is hereby corrected as shown below:

Column 1, Line 13, "poller" should be --polymer--.

Column 1, Line 14, "("LED")" should be --("LCD")--.

Column 2, Line 3, "polymer" should be --Polymer--.

Column 2, Line 34, "pixels" should be --pixel--.

Column 2, Line 64, "no" should be --not--.

Column 3, Line 24, "crystal/display" should be --crystal display--.

Column 3, Line 56, "a" (second occurrence) should be --as--.

Column 3, Line 59, "maybe" should be --may be--.

Column 3, Line 65, "a" should be --as--.

Column 4, Line 33, after "they" insert --are--.

Column 4, Line 65, "it's" should be --its--.

Column 4, Line 66, after "non-selected" insert --rows--.

Column 5, Line 47, "applying" should be --apply--.

UNITED STATES PATENT AND TRADEMARK OFFICE

CERTIFICATE OF CORRECTION

PATENT NO. : 5,644,330

DATED : July 1, 1997

INVENTOR(S) : Clive Catchpole, et al.

It is certified that error appears in the above-identified patent and that said Letters Patent is hereby corrected as shown below:

Column 6, Line 34, Claim 3, after "is" insert --a--.

Column 6, Line 37, Claim 4, after "is" insert --a--.

Column 7, Line 11, Claim 14, "V" should be --$V_3$--.

Column 7, Line 35, Claim 17, after "due" insert --to--.

Column 8, Line 26, Claim 17, "$V_4$-$V_3$/2" should be --($V_4$-$V_3$)/2--.

Column 8, Line 26, Claim 17, "$V_1$>$V_4$-$V_3$/2" should be --$V_1$>($V_4$-$V_3$)/2--.

Signed and Sealed this

Seventeenth Day of February, 1998

*Attest:*

Bruce Lehman

BRUCE LEHMAN

*Attesting Officer*

*Commissioner of Patents and Trademarks*